US010011887B2

(12) United States Patent
Bisson

(10) Patent No.: US 10,011,887 B2
(45) Date of Patent: Jul. 3, 2018

(54) SUPPORT DEVICE FOR RADIANT TUBES

(71) Applicant: Massimiliano Bisson, Tezze sul Brenta (IT)

(72) Inventor: Massimiliano Bisson, Tezze sul Brenta (IT)

( * ) Notice: Subject to any disclaimer, the term of this patent is extended or adjusted under 35 U.S.C. 154(b) by 359 days.

(21) Appl. No.: 14/758,830

(22) PCT Filed: Jan. 2, 2013

(86) PCT No.: PCT/IB2013/050031
§ 371 (c)(1),
(2) Date: Jul. 1, 2015

(87) PCT Pub. No.: WO2014/072839
PCT Pub. Date: May 15, 2014

(65) Prior Publication Data
US 2015/0337407 A1 Nov. 26, 2015

(51) Int. Cl.

| | |
|---|---|
| ***C21D 9/00*** | (2006.01) |
| ***C23C 30/00*** | (2006.01) |
| ***C21D 9/46*** | (2006.01) |
| ***F27D 99/00*** | (2010.01) |
| ***C21D 9/56*** | (2006.01) |

(52) U.S. Cl.
CPC ..... *C21D 9/0025* (2013.01); *C21D 9/0006* (2013.01); *C21D 9/0018* (2013.01); *C21D 9/46* (2013.01); *C21D 9/56* (2013.01); *C21D 9/562* (2013.01); *C23C 30/00* (2013.01); *F27D 99/0035* (2013.01)

(58) Field of Classification Search
CPC ..... F27D 99/0006; C21D 9/0025
See application file for complete search history.

(56) References Cited

U.S. PATENT DOCUMENTS

| | | | | |
|---|---|---|---|---|
| 4,520,789 A * | 6/1985 | Rombouts | C21D 9/0006 126/91 A |
| 8,877,120 B2 * | 11/2014 | Ebner | F23C 3/002 266/103 |
| 2011/0120453 A1 * | 5/2011 | Wunning | F23C 3/002 126/91 A |
| 2015/0337407 A1 * | 11/2015 | Bisson | C21D 9/0006 414/586 |

FOREIGN PATENT DOCUMENTS

| | | |
|---|---|---|
| AT | 508368 A4 | 1/2011 |
| KR | 20050017781 A | 2/2005 |

* cited by examiner

*Primary Examiner* — Scott Kastler
(74) *Attorney, Agent, or Firm* — Tutunjian & Bitetto, P.C.

(57) ABSTRACT

A radiant tubes support device, which can be used in furnaces for the thermal treatment, for continuous lines for galvanising and annealing strips or panels made of metal sheet or other products made of steel or other metals, including a furnace side wall support, constrained to a wall of the furnace, a radiant tube support provided with a tubular element and anti-sticking means between the tubular element and the furnace side wall support for supporting the radiant tube and allowing the lateral oscillation thereof, avoiding the sticking on the furnace side wall support.

12 Claims, 6 Drawing Sheets

SUPPORT DEVICE FOR RADIANT TUBES

TECHNICAL FIELD OF THE INVENTION

The present invention regards a radiant tubes support device for industrial plants and the like, which can be used in the industry for the thermal treatment of steel and/or other metals.

More in particular, the present invention regards a radiant tubes support device which can be used in the thermal treatment furnace industry, in the continuous lines for continuous galvanising and annealing (CGL or CAL lines) strips or panels made of metal sheet and/or other products made of steel and/or other metals.

Furthermore, the radiant tubes support device according to the present invention is used both for the new continuous lines for continuous galvanising and annealing (CGL or CAL lines) and for the revamping of old furnaces of continuous lines for continuous galvanising and annealing (CGL or CAL lines), in particular provided with W, U, double U or single P-shaped tubes, both centrifuged and made of metal sheet, to be replaced with double P-shaped tubes or generally with tubes made of metal sheet.

STATE OF THE PRIOR ART

In the industry for the thermal treatment of steel, in particular metal sheet, there are used particular types of radiant tubes, made of material resistant to high temperatures, so that the sheet which passes, in form of a continuous strip, in proximity of the same, may be subjected to the desired thermal treatment.

The radiant tubes usually used in the industry may assume different shapes, the most common of which may be defined to form an "I", a "U", a double "U", a "W" or an "M", a single "P", a "double P", a double "M" shape. In the continuous lines of the galvanising and annealing plants provided with the radiant tubes indicated above, due to the high operating temperatures, which averagely reach between 800° C. and 1250° C., there arise the problems related both to the sticking of the support of the radiant tube on the support installed and welded on the side of the furnace, the so-called "furnace side support" or "socket", and to the vibrations caused by the operativity of the tube which determines the lateral movement thereof (towards the right and/or towards the left). Due to the generally circular shape of the support of the radiant tube and the furnace side support and the similar dimensions thereof, to the radiant tube itself there is not allowed having the correct game of oscillations on the socket—due to the vibrations indicated above generating a sliding on the walls of the socket itself, with the increase of friction and the temperature therebetween.

This occurs regardless of the type of material used for providing the support of the radiant tube or the furnace side support. The radiant tubes, and the supports of the radiant tubes themselves, are generally made of a metallic material resistant to high temperatures, such as: alloys of nickel and chromium, for example made of Inconel 600, 601 or 602, Incoloy 800, Incoloy 800H, AISI304, 310, 309, 309S, 316, 316Ti, 330, 321, AVESTA235MA, ALUFER, ALLOY X, Kanthal materials such as APM, APMT, etcetera, Mitsubishi materials such as MA230, MA250, etcetera. Ni-resist cast iron or others derived from the cast iron; the radiant tubes are alternatively made of a metallic material cast, for example by centrifugation, with or without components of nickel, chromium, aluminium, etcetera, such as Gx40CrNi 26-20, KHR48N, KHR35H, etcetera, and/or other materials suitable for the purpose.

The furnace side wall support may be made of the same materials indicated above for the radiant tube or for the support thereof, comprising any combination of the same regarding the radiant tube and the furnace side support. For example, the material of the radiant tube may be made of stainless steel while the material of the furnace side support may be made of cast metallic material, or vice versa.

The difficulties of sliding and settling related to the vibrations between the radiant tube—in particular between the support thereof- and the furnace side support, caused by the friction generated by the contact of such metallic materials and by the oscillation caused by the operation of the tube, cause scratches on the contact surface thereof, possibly seizing and hence, anomalous stresses on the radiant tube. Such difficulty of sliding and settling also generates a series of forces which counter the natural extension of the radiant tube—which at 950° C. generally lies at around 4/7 cm—with ensuing further stresses caused in the same and in the support thereof. This leads to the support itself generating thrust forces on the part of the radiant tube on which it is applied—which usually has a curvilinear shape—thus causing the deformation and distortion thereof, up to reaching the breakage thereof with the ensuing collapse of the radiant tube. Such phenomenon is also referred to as the "seizing" effect of the support of the radiant tube and it may occur both on the base surface of the furnace side support and laterally, when the radiant tube support rests against the lateral walls of the furnace side support, due to the aforementioned oscillations and vibrations of the tube itself. Actually, due to the difficulty of extension caused by the sticking of the two materials or the oscillations, there occurs the creation of a torsion or deformation of the support, which definitely ceases extending on the furnace side support "jamming" thereon and thus causing the complete impossibility of the radiant tube to find a space for the natural extension thereof. In such situation, the tube pushes the support which, remaining blocked within the furnace side support, "jams" in the curvilinear portion of the tube on which it is installed, which, due to the high temperatures to which it is subjected, has low capacity of absorbing impacts and mechanical resistance. This leads to the total collapse of the radiant tube, as indicated previously.

The present invention regards both the area of the support of the radiant tube and, possibly, that of the furnace side support, thus overcoming the previously mentioned drawbacks.

SUMMARY OF THE INVENTION

Thus, the technical task of the present invention is that of improving the prior art.

Within such technical task, an object of the present invention is to provide a radiant tubes support device capable of allowing preventing the seizing and jamming phenomena, both central and lateral, of the radiant tube.

A further object of the present invention consists in providing a radiant tubes support device adapted to allow the movements of the support of the radiant tube on the furnace side support with the aim of compensating the seizing phenomena by extension caused by expansion or thermal dilatation of the radiant tube support.

A further object of the present invention consists in providing a radiant tubes support device adapted to prevent seizing phenomena caused by the fact that the material the tang is made of and the material the socket is made of melt and stick at high temperatures no longer leaving the radiant tube the possibility of sliding, thus such tube withdraws and deforms during cooling or changing the cycle of the line.

This task and object are attained by the radiant tubes support device according to the present principles.

Further characteristic advantages are described in the present specification.

BRIEF DESCRIPTION OF THE DRAWINGS

The characteristics of the invention shall be clearer to those skilled in the art from the description that follows and from the attached drawings, provided by way of non-limiting example, wherein.

DETAILED DESCRIPTION OF THE INVENTION

Figure 1:
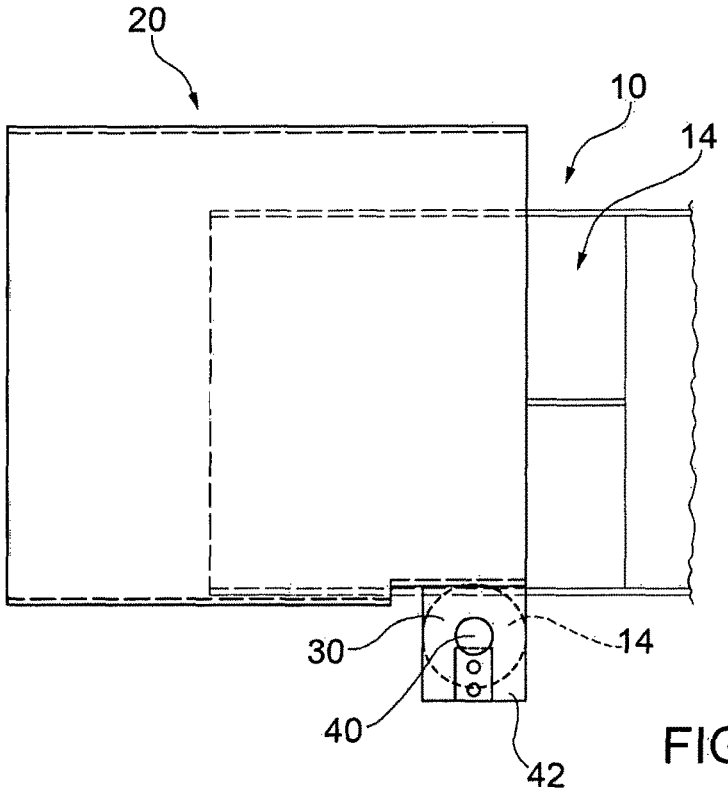
FIG. 1 is a lateral view of a variant of a radiant tubes support device according to the present invention.
Figure 2:
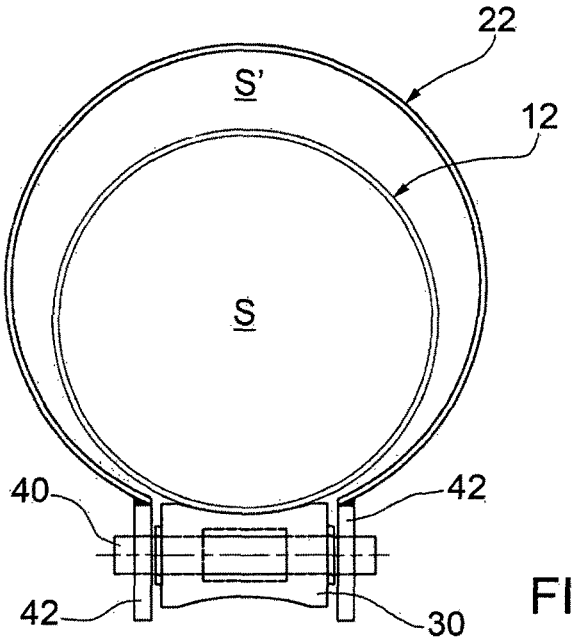
FIG. 2 is a front view of the radiant tubes support device subject of FIG. 1.
Figure 3:
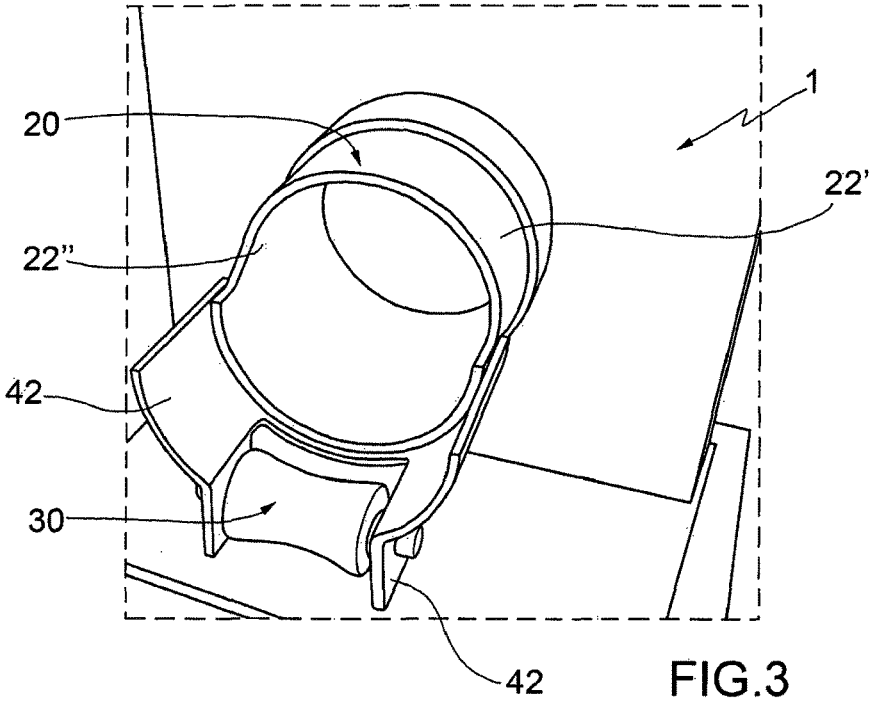
FIG. 3 is a front perspective view of the radiant tubes support device subject of FIGS. 1 and 2.
Figure 4:
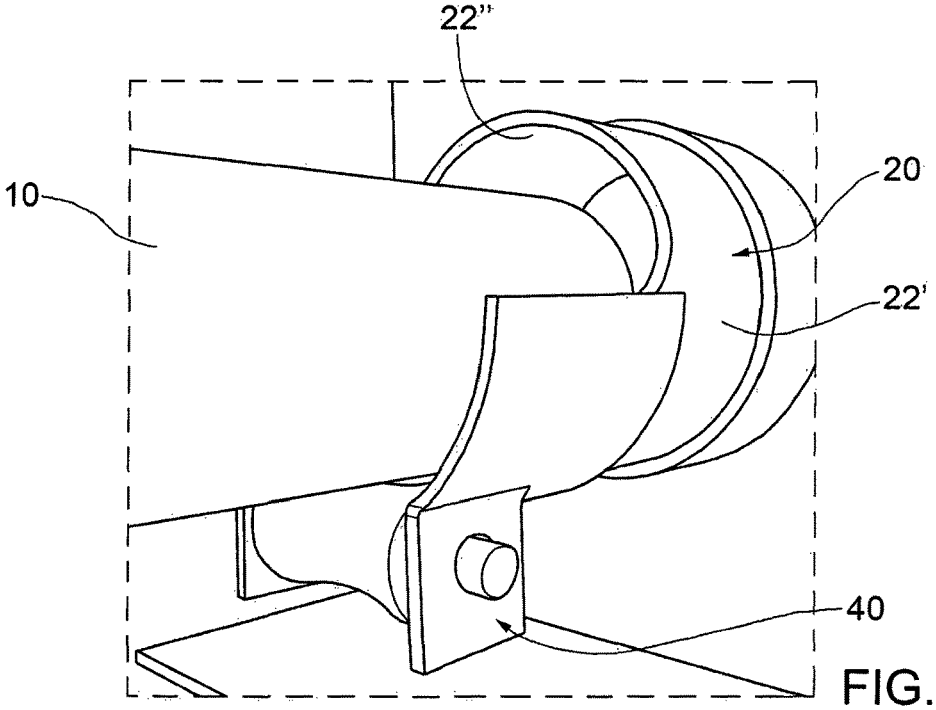
FIG. 4 is a further perspective view of the radiant tubes support device subject of FIG. 3.

With reference to the attached figures, a radiant tubes support device, which can be used in the furnaces for thermal treatment, for continuous lines for galvanising and annealing strips or panels made of metal sheet and/or other products made of steel and/or in other metals, in particular the lines CGL or CAL is indicated with 1.

The support device 1 comprises a radiant tube support 10 and a furnace side wall support 20.

The radiant tube support 10 is made of a metallic material and/or cast resistant to high temperatures, such as: alloys of nickel and chromium, for example made of Inconel 600, 601 or 602, Incoloy 800, Incoloy 800H, AISI304, 310, 309, 309S, 316, 316Ti, 330, 321, AVESTA235MA, ALUFER, ALLOY X, Kanthal materials such as APM, APMT, etcetera, Mitsubishi materials such as MA230, MA250, etcetera, Ni-resist cast iron or others derived from the cast iron.

The radiant tube support 10 is made of a metallic material and/or cast with or without components of nickel, chromium, aluminium, etcetera, such as Gx40CrNi 26-20, KHR48N, KHR35H, etcetera, and/or other materials suitable for the purpose.

The furnace side wall support 20, or "socket", is a support constrained to a wall of the furnace. In a variant of the invention, the furnace side wall support 20 is installed and welded on one side of the wall of the furnace.

The radiant tube support 10 is moveable and/or adapted to be positioned slidably within the furnace side wall support 20.

The furnace side wall support 20 may be made of the same materials indicated above for the radiant tube support 10.

Furthermore, the radiant tube support 10 and the furnace side wall support 20 may comprise any combination of the materials listed above. For example, the material of the radiant tube support 10 may be made of stainless steel and the material of the furnace side wall support 20 may be a cast metallic material, or vice versa.

In a variant of the invention, illustrated in FIGS. 1-4, the furnace side wall support 20 comprises a first tubular element 22, having an external surface 22' and an internal surface 22".

Figure 11:
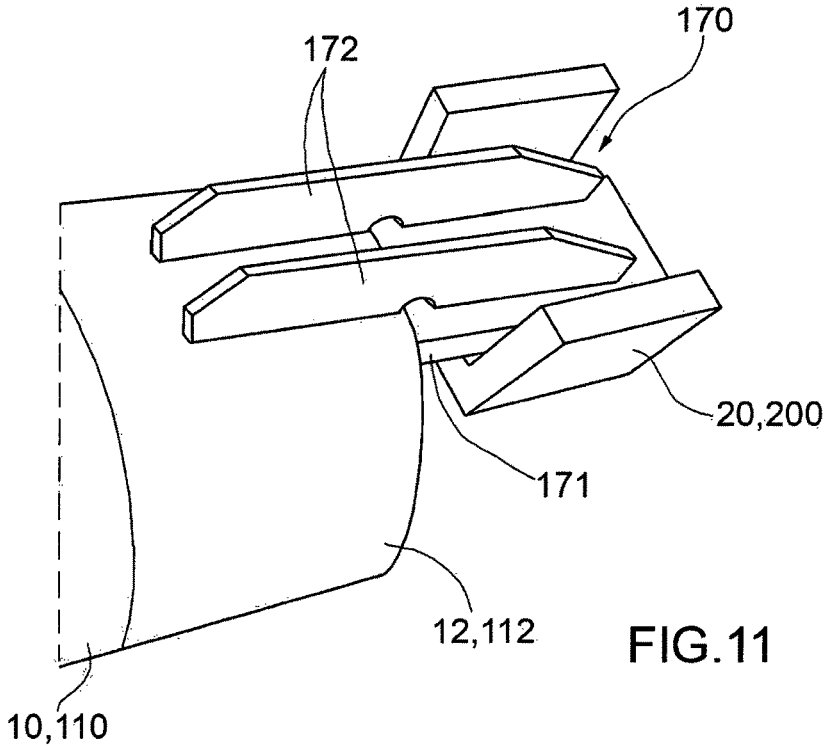
FIG. 11 is a perspective view of a detail of a further variant of the radiant tubes support device according to the present invention.

In a further variant, illustrated in FIG. 11, the furnace side wall support 20 comprises a flat configuration, as better described hereinafter.

The radiant tubes support device further comprises anti-sticking means for supporting the radiant tube and allowing the movement thereof or the oscillation on the furnace side wall support 20.

The radiant tube support 10 comprises a tubular element 12.

The anti-sticking means are positioned between the radiant tube support 10 or the tubular element 12 and the furnace side wall support 20.

In a variant of the invention, illustrated in FIGS. 1-4, the tubular element 12 of the radiant tube support 10 is positioned within the furnace side wall support 20.

The tubular element 12 rests on the internal surface 22" of the furnace side wall support 20.

The tubular element 12 may move, due to the vibrations of the radiant tube and the extension thereof, within the furnace side wall support 20, on the internal surface 22' thereof.

The radiant tube is fixed to the tubular element 12 of the radiant tube support 10.

The tubular element 12 of the radiant tube support 10 has a section S substantially corresponding to that of the end part or tang, usually tubular, of the radiant tube.

In the variant in which the furnace side wall support 20 comprises a first tubular element 22, the latter has a substantially corresponding section S', but larger in size, with respect to the section S of the tubular element 12.

In a further variant of the invention, the first tubular element 22 has a substantially corresponding section S', but smaller in size, with respect to the section S of the tubular element 12.

In a variant of the invention, the sections S and S' are substantially circular. In particular, the section S has a diameter comprised between 50 millimeters and 350 millimeters; the section S' has a diameter comprised between 55 millimeters and 500 millimeters or vice versa, i.e. the section S' has a diameter comprised between 50 millimeters and 350 millimeters while the section S has a diameter comprised between 55 millimeters and 500 millimeters.

The section S' is larger than the section S, so that the first tubular element 22 can contain the tubular element 12.

Alternatively, the section S' is smaller than the section S, so that the first tubular element 22 can be contained in the tubular element 12.

In a variant of the invention, the circular section S' has a larger or smaller diameter, with respect to the diameter of S, by at least 5 millimeters.

In a further variant of the invention, the sections S and S' have any geometric shape such as rectangular or square or oval or ellipsoidal or polygonal or triangular or any other section suitable for the purpose.

In a further variant of the invention, the furnace side wall support 20 has a "plate-like" configuration, substantially flat or possibly U-shaped (FIG. 11), made of sheet. This solution allows reducing the surface of contact and thus the possibility of sticking of the radiant tube with the furnace side wall support 20 and furthermore it allows a greater possibility of lateral oscillation of the very radiant tube.

The radiant tubes device 1 according to the present invention, particularly the anti-sticking means, have the purpose of reducing the contact surface between the furnace side wall support 20 and the radiant tube support 10 or the tubular element 12.

In a variant of the invention, the radiant tubes support device 1, particularly the anti-sticking means, comprise at least one rolling means 30 of the radiant tube support 10, particularly the tubular element 12 thereof, in the furnace side wall support 20, with the aim of preventing seizing or jamming phenomena of the radiant tube support 10, or of the tubular element 12, on the furnace side wall support 20. Thus, the anti-sticking means comprise at least one rolling means 30.

The at least one rolling means 30 comprises at least one wheel or one roller, etcetera.

The at least one rolling means 30 allows, the radiant tube support 10, extending by extension and thermal expansion, sliding and/or slipping and/or moving and/or extending within or on the furnace side wall support 20, reducing the contact sliding friction and transforming it into rolling friction, thus avoiding the occurrence of seizing phenomena and/or of the "jamming" effect.

The at least one rolling means 30 may be made of any material suitable for the purpose.

In a variant of the invention, the at least one rolling means 30, in form of a wheel, has a diameter of 50 millimeters or any other dimension suitable for the purpose.

In a variant of the invention, there are present two rolling means 30.

In a variant of the invention, the two rolling means 30 are positioned in diametrically opposite positions with respect to the radiant tube support 10.

In a further variant of the invention, the two rolling means 30 are positioned one behind the other with respect to the radiant tube support 10.

In a variant of the invention, the at least one rolling means 30 is fixed on the furnace side wall support 20.

In a further variant, the at least one rolling means 30 is fixed on the radiant tube support 10. In such case, in the furnace side wall support 20 there may be present many guides or sliding means or start and/or end-stop means with the aim of directing the radiant tubes support 10 and the at least one rolling means 30 in the correct sliding and use direction, avoiding possible phenomena of seizing or exiting from the correct seat of the furnace side wall support 20.

This is however adopted considering the clearance required by the radiant tube or the radiant tube support 10 with respect to the furnace side wall support 20 for moving even laterally.

The furnace side wall support 20 or the radiant tube support 10 further comprises at least one rotary fixing means 40. The rotary fixing means 40, provided with a pin, is adapted to rotatably fix the at least one rolling means 30 on the furnace side wall support 20 or on the first tubular element 22.

In a further variant of the invention, the rotary fixing means 40 is adapted to rotatably fix the at least one rolling means 30 on the radiant tube support 10.

The rotary fixing means 40 further comprises a pair of brackets 42 for fixing to the furnace side wall support 20 or to the first tubular element 22 or to the outer surface 22' thereof or to the radiant tube support 10.

The rotary fixing means 40 is fixed to the furnace side wall support 20 or to the first tubular element 22 or to the outer surface 22' thereof or to the radiant tube support 10 by welding or in any other manner suitable for the purpose.

In a further variant of the invention, the rotary fixing means 40 is fixed to the inner surface 22" of the furnace side wall support 20 or of the first tubular element 22.

In a further variant of the invention, the rotary fixing means 40 is fixed in a position adjacent to the furnace side wall support 20.

In a further variant of the invention, illustrated in FIGS. 5-8, there is represented a radiant tubes support device 100.

Hereinafter, the elements which present characteristics identical to those described previously shall be identified with the same reference numbers increased by 100 units.

The support device 100 comprises a radiant tube support 110 and a furnace side wall support 120.

The radiant tube support 110 is adapted to be positioned within the furnace side wall support 120. The radiant tube support comprises a tubular element 112.

The furnace side support 120 may comprise a first tubular element 122 or a "plate-like" or U-shaped structure.

The radiant tube support 110 comprises a protrusion 170.

The protrusion 170, in a variant of the invention, departs from the tubular element 112 of the radiant tube support 110. In such variant of the invention, the anti-sticking means comprise at least one protrusion 170.

The protrusion 170 is made of the same material wherein the radiant tube support 110 is made of or made of ceramic material or any material capable of withstanding high temperatures up to 2000° C. and reduce friction to the minimum.

The protrusion 170 allows the support of and considerable reduces the possibilities of seizing of the radiant tube in the furnace side wall support 120, simultaneously considerably reducing the contact surface, and thus the friction, and leaving great possibility to the radiant tube to oscillate laterally and extend, together with the radiant tube support 110 thereof, without coming to contact with the furnace side wall support 120.

Figure 6:
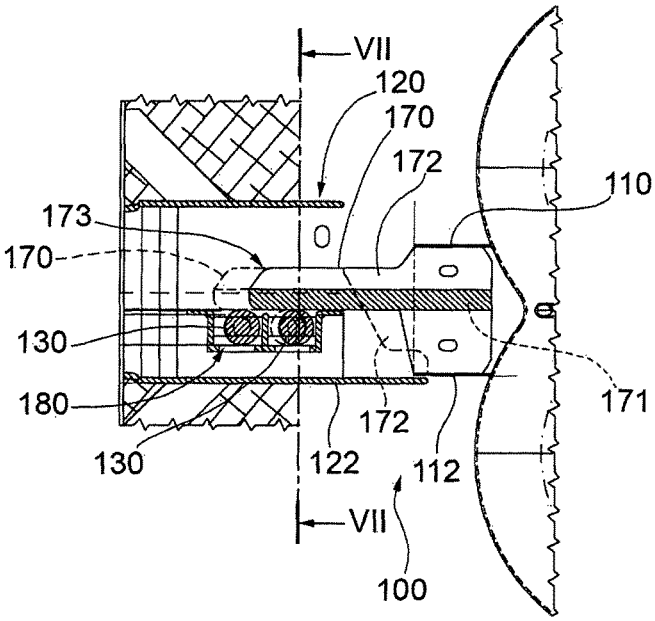
FIG. 6 is an enlarged detail of the radiant tubes support device subject of FIG. 5.
Figure 7:
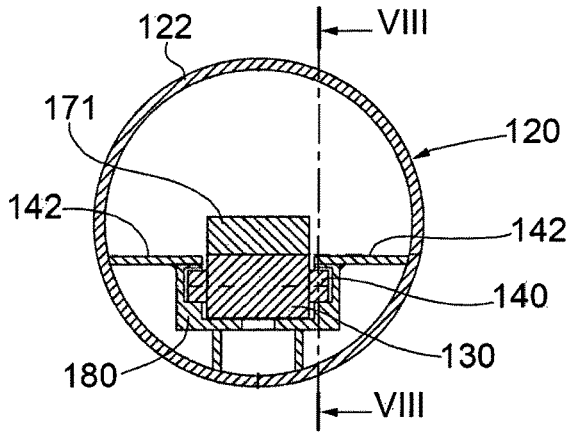
FIG. 7 is a transverse sectional view VII-VII of the radiant tubes support device subject of FIGS. 5 and 6.

In FIG. 6, the protrusion 170 during the sliding of the same within the furnace side wall support 120 during the extension and the expansion of the radiant tube during use is indicated with a dashed line.

The protrusion 170 may be inserted within the first tubular element 122 of the furnace side wall support 120 or moving on the inner surface 122" thereof.

The protrusion 170 comprises a rest base 171. The rest base 171 has, in a variant of the invention, a configuration—in plan view—substantially rectangular or however substantially extended and narrow, with the aim of serving the described functions and a configuration—in transverse section—i.e. orthogonal with respect to the horizontal longitudinal direction of the protrusion 170, substantially flat.

Figure 12:
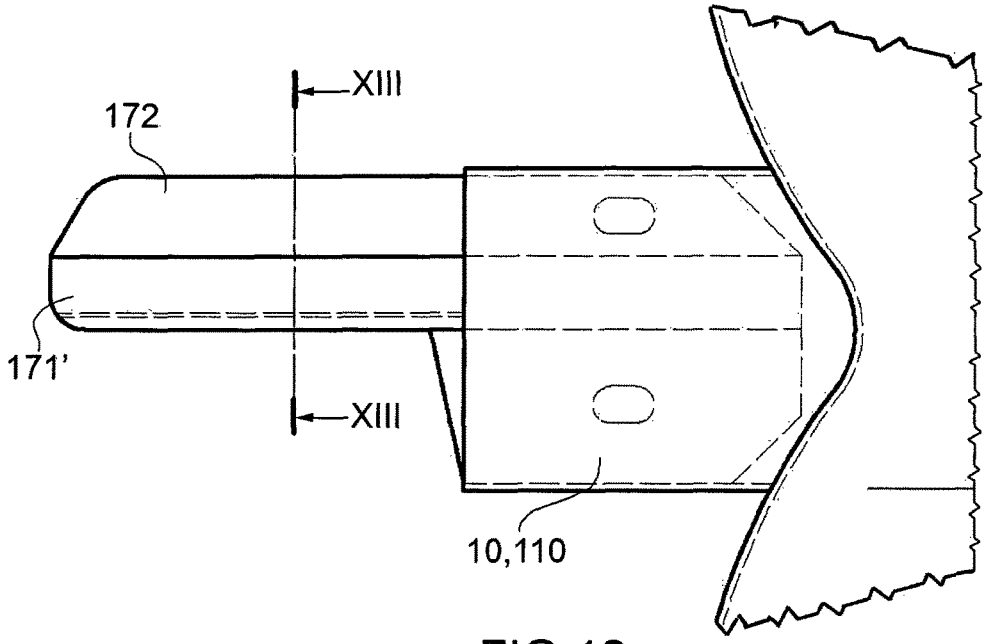
FIG. 12 is a lateral view of a further variant of a radiant tubes support device according to the present invention.
Figure 13:
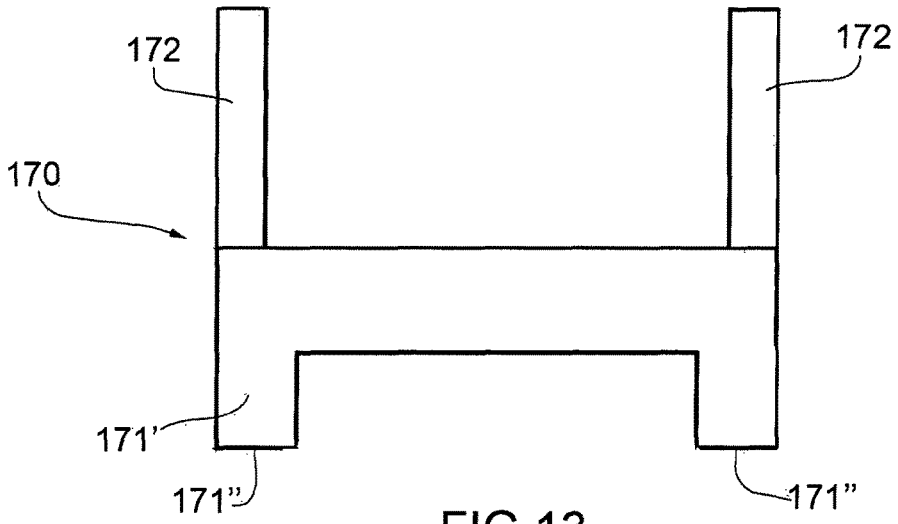
FIG. 13 is an enlarged view and in longitudinal section XIII-XIII of the radiant tubes support device subject of FIG. 12.

In a further variant of the invention, illustrated in the FIGS. 12 and 13, the protrusion 170 comprises a rest base 171' having a configuration in plan view substantially rectangular or however substantially extended and narrow, with the aim of serving the described functions and a configuration—in transverse section—i.e. orthogonal with respect to the horizontal longitudinal direction of the protrusion 170, substantially inverted-U-shaped.

Such inverted U-shape of the support base 171' of the protrusion 170 allows further reducing the friction between the same and the first tubular element 122 of the furnace side wall support 120 or the inner surface 122" thereof. Actually, in such manner, the surface for contact with the surface on which the protrusion moves, solely given by the free ends 171" of the inverted U-shaped element, is further reduced with respect to the support base 171, wherein the support surface is given by the entire surface of the support base 171.

For example, while the rest surface 170 has a contact surface with the furnace side wall support 120 of 7 cm of width, the rest base 171' has a contact surface equivalent to 2 cm of width, given by the two free ends 171" of the inverted U-shaped element, each of which measure 1 cm in width.

The inverted-U-shaped configuration of the rest base 171' may have more or less rounded or squared folding angles.

In a further variant of the invention, the inverted-U-shaped configuration is obtained by forming a groove or longitudinal tunnel at the contact surface of the rest base 171 of the protrusion 170.

The protrusion 170 may further comprise lateral portions 172 of connection between the end portion, or tang, or tubular element 112 of the radiant tube ending up at the distal end 173 of the protrusion 170. Such lateral portions 172 serve as reinforcement for the protrusion 170.

The radiant tubes support device 100 comprises at least one rolling means 130 of the radiant tube support 110 in the furnace side wall support 120, with the aim of preventing seizing or jamming phenomena of said radiant tube support 110 on said furnace side wall support 120. The at least one rolling means 130 comprises at least one wheel or one roller, etcetera.

In a variant of the invention, the rolling means 130 are higher by at least 1.5 mm with respect to the housing 180, which will be described in detail hereinafter, with the aim of facilitating the extension of the support base 171 thereon.

Alternatively, they may be positioned flushed with respect to the housing 180.

The at least one rolling means 130 allows the radiant tube support 110, oscillating and extending by expansion and thermal expansion, to be inserted and moved within the furnace side wall support 120, reducing contact sliding friction, and possibly transforming it into rolling friction, thus avoiding the occurrence of seizing phenomena and/or "jamming" effects.

Figure 5:
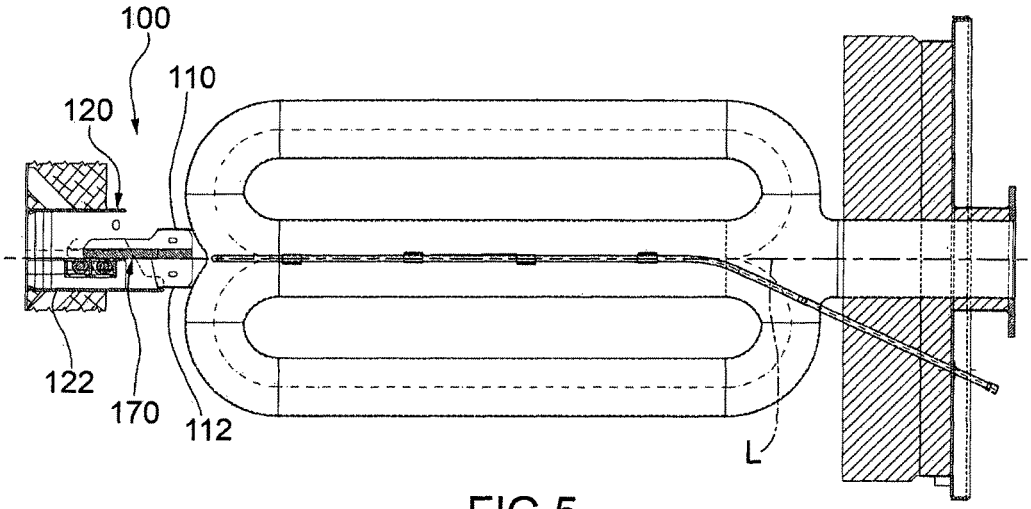
FIG. 5 is a lateral view of a radiant tube and of a further variant of a radiant tubes support device according to the present invention.
Figure 8:
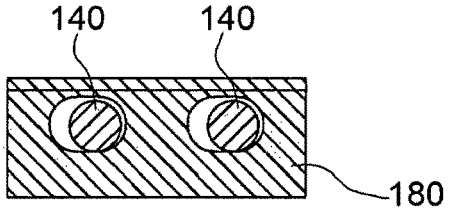
FIG. 8 is a longitudinal sectional view VIII-VIII of the radiant tubes support device subject of FIG. 7.

In the variant of the invention illustrated in FIGS. 5, 6 and 8, there are provided two rolling means 130, positioned in series, one behind the other, with the aim of facilitating the extension of the protrusion 170 thereon.

The at least one rolling means 130 may be fixed within the furnace side wall support 120 or of the first tubular element 122 or the inner surface 122" thereof or the radiant tube support 110 through at least one rotary fixing means 140. The rotary fixing means 140, provided with a pin, is adapted to rotatably fix the at least one rolling means 130 on the furnace side wall support 120 or on the first tubular element 122 or on the inner surface 122" thereof or on the radiant tube support 110.

In particular, in a variant of the invention, the at least one rotary fixing means 140 and/or the at least one rolling means 130 is positioned within of at least one housing 180.

Such housing 180 comprises at least one pair of brackets 142 for fixing to the furnace side wall support 120 or to the radiant tube support 110.

The rotary fixing means 140 is rotatably fixed to the opposite lateral walls of the housing 180 by welding or in any other manner suitable for the purpose.

In a further variant of the invention, the rotary fixing means 140 and the housing 180 are positioned in any other position suitable for the purpose.

In a variant of the invention, the radiant tube has a central longitudinal axis L passing through the longitudinal centre of the central tube of the radiant tube. The axis L passes through the centre in the longitudinal direction even of the end portion, or tang, of the radiant tube.

In such a variant, the support base 171 of the protrusion 170 and the rolling means 130 are arranged so that the insertion of the radiant tubes support 110 occurs along the axis L and/or coaxially with respect to the axis L, within the furnace side wall support 120.

Thus, extension forces which are broken up with respect to the direction of extension are eliminated, facilitating the reduction of the friction between such elements.

In an even further embodiment of the present invention, not illustrated in the attached drawings, the protrusion 170 which departs from the radiant tubes support 110 is inserted into a furnace side support of the conventional type. Thus, due to the increase of the free space between the protrusion and the furnace side support, there is increased the possibility of circulation of the air therewithin, with the ensuing reduction of the temperature present therein and thus the reduction of the possibility of jamming or seizing during use, thus furthermore there is reduced the contact surface and hence the friction between the two materials.

Figure 9:
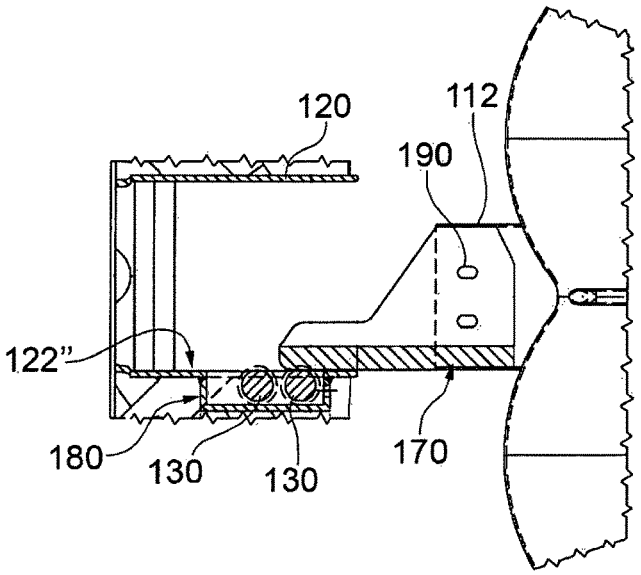
FIG. 9 is a lateral view of a further variant of a radiant tubes support device according to the present invention.

In a further variant of the invention, illustrated in FIG. 9, the housing 180 is positioned beneath the furnace side wall support 120 and the rolling means 130 project, internally, from the latter, by at least 1.5 mm. The protrusion 170 rests, with the support base 171 thereof, thus, on the rolling means 130 along a direction parallel to the axis L of the radiant tube but not on the same, and more precisely, on the inner surface 122" of the furnace side wall support 120. A similar embodiment is illustrated in FIG. 11, in which the protrusion 170 is inserted on the furnace side wall support 20, 120 having a "plate-like" and/or U-shaped configuration.

The protrusion 170 may, in a further variant of the invention, be installed on the other sides of the radiant tube support 110, i.e. above, beneath or laterally, or it may be installed on the furnace side wall support 120. In such case the protrusion 170 projects from the furnace side wall support 120 and the radiant tube support 110, of any form, slides thereon.

In such version the rotary fixing means 140 may not be present, with the aim of reducing the frictions and the possibility of locking to the minimum. In such case, the rolling means 130 substantially occupy the entire width of the housing 180, with the aim, during the rotation, of remaining in the desired seat thereof.

In the tubular element 12, 112 or in the protrusion 170 of the radiant tubes support 10, 110 holes 190 may be present, with the aim of further increasing the circulation of air in such zone, simultaneously lowering the temperature thereof.

Even the furnace side wall support 20, 120 may have holes 190 for such purpose.

On the sides of the housing 180 and/or of the rolling means 30, 130 there may be present guide elements (not illustrated) with the aim of guiding the insertion, thereabove, of the radiant tubes support 10, 110.

Naturally, the radiant tubes support 10, 110, the tubular element 12, 112 and/or the protrusion 170 may move, besides on the rolling means 30, 130, also directly on the first tubular element 22, 122 of the furnace side wall support 20, 120. However, due to the characteristics thereof, the small dimensions and small overall dimensions of the protrusion 170, the temperature is reduced and also the amount of friction, thus causing a reduction of the risk of blocking, seizing or any other phenomena.

An advantage conferred by the presence of the at least one rolling means 30, 130 is the possibility of considerably reducing the contact surface of the tubular element 12, 112 or of the protrusion 170 of the radiant tube support 10, 110 on the furnace side wall support 20, 120 or on the tubular element 22, 122. Actually, due to the presence of the at least one rolling means 30, 130, the tubular element 12, 112 or the protrusion 170 of the radiant tube support 10, 110 is inserted into the furnace side wall support 20, 120 or of the tubular element 22, 122 of the furnace side wall support 20, 120 on a surface equivalent to that of the at least one rolling means 30, 130.

Furthermore, in the case of the protrusion 170, increasing the free space between the same and the furnace side wall support 120, there increases the possibility of circulation of air therewithin, with the ensuing reduction of the temperature present therein and thus the reduction of the possibility of jamming or seizing during use, simultaneously increasing the possibility of lateral oscillation of the tube itself.

Reducing the support surface—which in the supports of the known type corresponds to about a quarter of the diameter of the radiant tubes support—allows reducing the known drawbacks caused by friction, seizing, deformation, jamming and oscillation which lead to the collapse of the radiant tube itself.

The radiant tube support 10, 110 has a coating 14, on at least part of the surface of the tubular element 12, 112 and/or of the protrusion 170.

The coating 14 comprises an anti-friction material or a material obtained from specific thermal treatments, for example based on carbon tungsten or any other elements, or a material with the function of creating a different roughness with a different coefficient of friction between the two supports, with the aim of preventing the aforedescribed seizing phenomena.

The coating 14 may be applied through any method, including welding and addition of extremely hard material and resistant to high temperatures.

In a variant of the invention, the coating 14 is made of a hardening material. Actually, the material the coating 14 is made of has a hardness greater than that of the material the radiant tube support 10, 110 is made of and thus it is adapted to harden such material and increase the resistance thereof to wear. Thus, the radiant tube support 10, 110 has a resistance to deformation considerably greater than that of the non-coated material.

In a further variant of the invention, the coating 14 may comprise a less hard material with respect to that of the radiant tube support 10, 110.

The coating 14 may be a welding filler material.

Furthermore, the material of the coating 14 may have a smooth, shiny and homogeneous surface, thus conferring less friction, so as to reduce or prevent the seizing and the jamming effect of the radiant tube support 10, 110 on the furnace side wall support 20, 120 and increasing the possibility of oscillation thereof.

Actually, the coating 14, penetrates into the material of the radiant tube support 10, 110 and/or of the furnace side wall support 20, 120 and occludes the natural micro-cavities thereof thus reducing its roughness.

In an embodiment, the coating 14 comprises a coating film.

The coating 14 has a thickness comprised between 0.1 microns and 30 millimeters or between 0.1 microns and 50 millimeters.

In particular, the coating 14, in case of an actual coating, may have a thickness comprised between 0.1 microns and 1 millimeter; the coating 14, in case of a welding filler material, may have a thickness comprised between 0.5 microns and 5 millimeters.

The coating 14 may be applied on any metallic and non-metallic material, as well as on any ceramic material.

Furthermore, due to the device of the present invention, there is considerably reduced, as indicated above, the friction between the various parts that move on each other, considerably reducing the wear therebetween and possibly avoiding reducing the layer of the coating 14, simultaneously guaranteeing a better duration of the plant itself.

The coating 14 is constituted by a microcrystalline structure approximately prismatic with rounded corners, compact, uniform, without spots, non-covered zones, scratches, dust, or powder residues.

In a further variant of the invention, the coating 14 is present on at least part of the surface of the tubular element 22, 122 of the furnace side wall support 20, 120. In still a further variant of the invention, the coating 14 is present on at least part of the surface of the tubular element 12 or of the protrusion 170 of the radiant tube support 10 and on at least part of the surface of the tubular element 22, 122 of the furnace side wall support 20, 120.

In a further variant of the invention, the coating 14 is present on at least part of the anti-sticking means according to the present invention.

In a variant of the invention, the coating 14 is present in at least part of the surface of the at least one rolling means 30, 130 and/or of the rotary fixing means 40, 140. In particular, the part of the surface of the at least one rolling means 30, 130 coated with the coating 14 is that at contact with the radiant tube support 10, 110.

Figure 10:
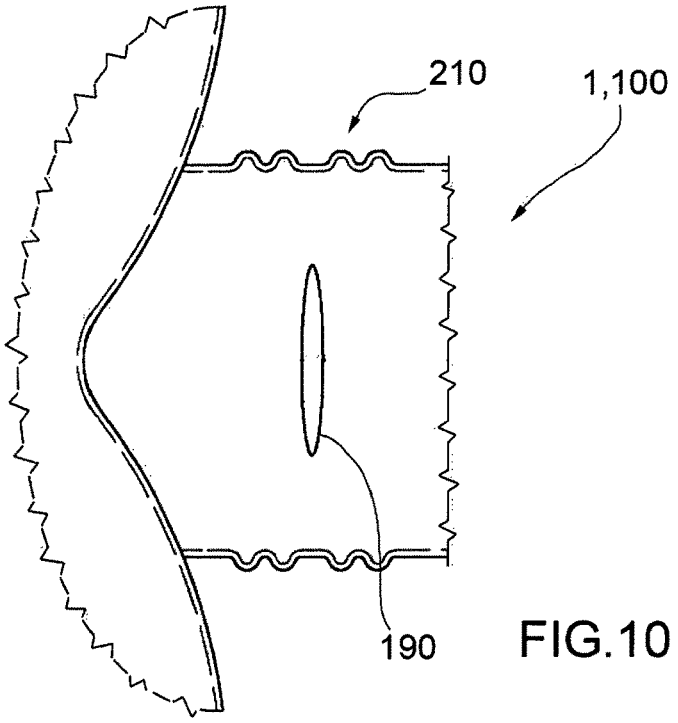
FIG. 10 is an enlarged view of a detail of the radiant tubes support device according to the present invention.

In FIG. 10 there is illustrated a particular machining to be carried out in the radiant tube support 10, 110 with the aim of increasing the capacity of damping possible stresses caused on the radiant tube by possible blocking phenomena or jamming. In particular, the radiant tubes support 10, 110 has a corrugation or bellow or compensator 210. Such corrugation or bellow or compensator 210 is adapted to absorb at least part of the thrust of the radiant tube on the radiant tube support 10, 110 in case of sticking thereof with furnace side wall support 20, 120, allowing the radiant tube to be subjected to expansion, like a sort of "bellow" regardless of the adherence, over a given distance without damaging the radiant tube.

It has thus been observed that the invention attains the proposed objects.

The present invention has been described according to preferred embodiments but equivalent variants may be conceived without departing from the scope of protection outlined by the claims that follow. Furthermore, the characteristics described for a variant or embodiment may also be present in other variants or forms of use, without departing from the scope of protection outlined by the claims that follow.

The invention claimed is:

1. A radiant tubes support device for use in a furnace, comprising: a furnace side wall support, attached to a wall of the furnace; a radiant tube support having a tubular element; and at least one anti-sticking means comprising at least one protrusion which extends from a terminal edge of said tubular element of said radiant tube support, wherein said at least one protrusion is positioned between said tubular element and said furnace side wall support for supporting said radiant tube and is movable within the furnace side wall support for allowing lateral oscillation and the extension of the tubular element with respect to said furnace side wall support.

2. The device according to claim 1, wherein said at least one protrusion comprises a base for resting on said furnace side wall support, wherein said base has at least one of a substantially flat shape or inverted U shape in a transverse section.

3. The device according to claim 1, wherein said protrusion comprises lateral portions connecting said protrusion with said tubular element of said radiant tube support.

4. The device according to claim 1, further comprising at least one rolling means comprising at least one wheel or roller, for at least one of said tubular element, said protrusion or for said furnace side wall support, wherein said at least one wheel or roller, is positioned in or on said furnace side wall support or in or on said radiant tube support, to prevent seizing or jamming phenomena of said radiant tubes support on said furnace side wall support.

5. The device according to claim 4, further comprising a rotary fixing means provided with at least one of a pin and at least one pair of brackets fixed to at least one of said furnace side wall support or to said radiant tube support and, rotatably, to said at least one rolling means, adapted to rotatably fix said at least one rolling means on said furnace side wall support or on said radiant tube support and/or comprising at least one housing in which the at least one rolling means and/or the at least one rotary fixing means are contained.

6. The device according to claim 1, further comprising a coating provided on at least one of the tubular element and the protrusion, the coating comprising a low friction material, or a material obtained from specific thermal treatments based on carbon tungsten or zirconium or any other material, or a material with the function of creating a determined roughness and preventing the seizing and sticking or a hardening material or having a hardness greater than that of the material on which it is applied or a different roughness or a different coefficient of friction, or a welding filler material, wherein said coating is applied on at least part of at least one from among said radiant tube support and/or said furnace side wall support and/or said at least one rolling means and/or said rotary fixing means and/or said protrusion and/or said tubular element of said radiant tube support.

7. The device according to claim 6, wherein said coating has a thickness comprised between 0.1 microns and 1 millimeter.

8. The device according to claim 1, wherein at least one of said tubular element or said protrusion or said radiant tubes support or said furnace side wall support comprise holes.

9. The device according to claim 1, wherein said radiant tube support comprises at least one corrugation or bellow or compensator adapted to absorb at least part of the thrust of the radiant tube on the radiant tube support in case of sticking thereof with the furnace side wall support.

10. The device according to claim 2, wherein at least one of said furnace side wall support, said radiant tube support, said protrusion, said at least one rolling means or said at least one rotary fixing means comprises a ceramic material or a metallic material resistant to high temperatures, selected from among one or a combination of the following materials: alloys of nickel and chromium, Inconel 600, 601 or 602, Incoloy 800, Incoloy 800H, AISI304, 310, 309, 309S, 316, 316Ti, 330, 321, AVESTA235MA, ALUFER, ALLOY X, Kanthal materials, APM, APMT, Mitsubishi materials, MA230, MA250, Ni-resist cast iron or others derived from cast iron or a metallic material cast with or without components of nickel, chromium, aluminium, etcetera, selected from among one or a combination of the following materials: Gx40CrNi 26-20, KHR48N, KHR35H.

11. The device according to claim 1, said furnace side wall support having a circular cross-section S' and the tubular element having a circular cross-section S, wherein section S' is larger than S.

12. The device according to claim 6, wherein said coating has a thickness comprised between 0.5 microns and 5 millimeters.

* * * * *